US012709844B2

(12) United States Patent
Schulte et al.

(10) Patent No.: US 12,709,844 B2
(45) Date of Patent: Aug. 18, 2026

(54) COATED PAPER

(71) Applicant: KOEHLER INNOVATION & TECHNOLOGY GMBH, Oberkirch (DE)

(72) Inventors: Marius Schulte, Oberkirch (DE); Claus Jurisch, Offenburg (DE); Christian Kind, Baden-Baden (DE); Dominik Hoferer, Lautenbach (DE); Aljoscha Föll, Appenweier (DE)

(73) Assignee: KOEHLER INNOVATION & TECHNOLOGY GMBH, Oberkirch (DE)

( * ) Notice: Subject to any disclaimer, the term of this patent is extended or adjusted under 35 U.S.C. 154(b) by 417 days.

(21) Appl. No.: 18/024,526

(22) PCT Filed: Sep. 6, 2021

(86) PCT No.: PCT/EP2021/074499
§ 371 (c)(1),
(2) Date: Oct. 6, 2023

(87) PCT Pub. No.: WO2022/049286
PCT Pub. Date: Mar. 10, 2022

(65) Prior Publication Data

US 2024/0229359 A1 Jul. 11, 2024

(30) Foreign Application Priority Data

Sep. 4, 2020 (DE) ..... 102020123150.4

(51) Int. Cl.

| | |
|---|---|
| ***D21H 19/82*** | (2006.01) |
| ***D21H 19/40*** | (2006.01) |
| ***D21H 19/56*** | (2006.01) |
| ***D21H 19/72*** | (2006.01) |
| ***D21H 21/16*** | (2006.01) |

(52) U.S. Cl.
CPC ..... *D21H 19/82* (2013.01); *D21H 19/40* (2013.01); *D21H 19/56* (2013.01); *D21H 19/72* (2013.01); *D21H 21/16* (2013.01)

(58) Field of Classification Search
CPC ..... D21H 19/18; D21H 19/20; D21H 19/22; D21H 19/40; D21H 19/56; D21H 19/58; D21H 19/72; D21H 19/82; D21H 19/84; D21H 21/16; D21H 23/48
See application file for complete search history.

(56) References Cited

U.S. PATENT DOCUMENTS

| | | | | |
|---|---|---|---|---|
| 6,441,880 | B1 | 8/2002 | Berube | |
| 11,280,049 | B2 | 3/2022 | Tsuruhara et al. | |
| 2008/0003388 | A1 | 1/2008 | Murphy et al. | |
| 2016/0168799 | A1* | 6/2016 | Constant | D21H 21/16 493/110 |
| 2018/0135251 | A1* | 5/2018 | Constant | B32B 27/06 |
| 2019/0203423 | A1* | 7/2019 | Niemi | D21H 21/52 |
| 2021/0002828 | A1* | 1/2021 | Grundl | D21H 19/62 |
| 2023/0039088 | A1* | 2/2023 | Föll | D21H 19/385 |

FOREIGN PATENT DOCUMENTS

| | | | |
|---|---|---|---|
| CN | 1571728 | A | 1/2005 |
| CN | 102227459 | A | 10/2011 |
| DE | 102017131277 | A1 | 6/2019 |
| DE | 102019103343 | A1 | 8/2019 |
| EP | 0671506 | A2 | 2/1995 |
| EP | 1249533 | A1 | 4/2001 |
| EP | 1228889 | A2 | 8/2002 |
| EP | 1416087 | A1 | 5/2004 |
| JP | 2002-068283 | A | 3/2002 |
| JP | 2012505321 | A | 3/2012 |
| JP | 2020066216 | A | 4/2020 |
| WO | 2004035929 | A1 | 4/2004 |
| WO | 2010042162 | A1 | 4/2010 |
| WO | 2012168433 | A1 | 12/2012 |
| WO | 2019199491 | A1 | 10/2019 |

OTHER PUBLICATIONS

Office Action for Chinese Patent Application No. 202180054417.4, dated Jan. 9, 2024, 8 pages.
Office Action for Japanese Patent Application No. 2023514437, dated Apr. 19, 2024, 21 pages.
PCT ISR Translation, (PCT/EP2021/074499) Jan. 5, 2022 (5 pages).
PCT WR Opn, (PCT/EP2021/074499) (7 pages).
Third Party Observation European Patent No. 21777419.9, dated Nov. 14, 2024, 8 pages.
Sales Specification for Selvol Polyvinyl Alcohol 21-205 Solution; Sekisui Speciality Chemicals LLC; 2012.
Printing & Packaging,Fuctional Packaging Coatings Technical Data Sheet for Joncryl 74-A; BASF Corporation, Sep. 2019; 2 pages.

* cited by examiner

*Primary Examiner* — Blaine Copenheaver
(74) *Attorney, Agent, or Firm* — Lippes Mathias LLP

(57) ABSTRACT

What is described is a coated paper comprising a base paper and at least three coatings applied thereto, wherein the at least three coatings, proceeding from the base paper, in this sequence, comprise a first barrier layer comprising at least one hydrophobic polymer, a second barrier layer comprising at least one hydrophilic polymer, and a third barrier layer comprising at least one hydrophobic polymer, a method for producing such a coated paper, and the use of the coated paper as packaging material.

18 Claims, No Drawings

COATED PAPER

This application is a National Stage Entry of International Application No. PCT/EP2021/074499, filed Sep. 6, 2021, and claims the priority benefit of German Patent Application No. 10 2020 123 150.4, filed Sep. 4, 2020.

The present invention relates to a coated paper, to a method for producing a coated paper of this kind, and to the use of the coated paper as packaging material.

A packaging generally refers to the covering or (the partial or complete) wrapping of an object, in particular for its protection or for better handling. Consequently, a packaging material comprises the material forming such a packaging.

Packaging materials can be constructed for example on the basis of paper, plastics and/or metals. The present invention is concerned with packaging materials based on paper.

Packaging materials based on paper are known. However, until now, no fibre-/paper-based flexible packaging material has been known that is suitable for the packaging of oxidation-sensitive, moist, and fat-containing objects, in particular foods, and at the same time is free from halogen-containing compounds or barrier layers made of aluminium, $Al_2O_3$ and/or $SiO_2$, which have to be applied outside a paper coating machine by means of lamination or vapour deposition.

The use of aluminium and/or $Al_2O_3$ is in particular disadvantageous since the recovery of aluminium, also for the $Al_2O_3$ coating, is resource- and energy-intensive. In the production of aluminium, with each tonne approximately three to five times as much carbon dioxide is released as compared to the production of plastics, for example polyethylene. Aluminium is increasingly being criticised as a packaging material, in particular for moist and acid-containing foods, since $Al^{3+}$ salts may dissolve. In addition, the recovery of aluminium from barrier papers is associated with additional effort. For instance, such papers for example have to be boiled in water for some time under pressure at 120° C. in order to detach the paper fibres from the metal.

The use of $SiO_2$ is disadvantageous in particular since, depending on the required degree of purity, $SiO_2$ cannot be obtained from "sand" but only from quartz quarries. Furthermore, an application process (chemical vapour deposition) that presupposes slow machine running and signifies an additional cost expenditure has to be used here.

Both $SiO_2$ and $Al_2O_3$ coatings may also be disadvantageous in respect of the resistance to bending.

The use of halogenated compounds is in particular disadvantageous since halogenated compounds, such as halogenated hydrocarbons, due to their hydrophobic nature are very stable in respect of biological breakdown. Sunlight or other weathering influences also have hardly any influence on these compounds. In combustion processes, corrosive hydrogen halides and dioxines also accrue in addition to the usual by-products of the thermal utilisation of plastics.

Known packaging materials often contain compounds such as polyvinylidene chloride (PVDC; halogen-containing), have a tear strength that has scope for improvement, which may lead to running problems on packaging plants, and in addition are not recyclable via the paper fibre stream on account of an excessively high coating content. Furthermore, known packaging materials have an excessively high permeability for water, water vapour, oxygen and grease, and thus lead to a low shelf life of the packaged product.

The object of the present invention is to overcome the disadvantages of the known materials and to provide a material that is suitable as a packaging material, in particular for oxidation-sensitive, moist and fatty foods and that can be used for the production of pouches by means of a heat sealing application. Furthermore, the material should not contain any barrier layers based on halogen-containing compounds, aluminium, $Al_2O_3$ and/or $SiO_2$. In addition, as far as possible, there should be no adhesion promoter used between the individual layers of the material. Furthermore, the material according to the invention should be as easy to produce as possible and should get by with the lowest possible application weights so that it can be recycled via the paper fibre stream.

This object is achieved by a coated paper according to claim 1, i.e. by a coated paper comprising a base paper and at least three coatings applied thereto, wherein the at least three coatings, proceeding from the base paper, in this sequence, comprise a first barrier layer comprising at least one hydrophobic polymer, a second barrier layer comprising at least one hydrophilic polymer, and a third barrier layer comprising at least one hydrophobic polymer.

A paper coated in this way is distinguished in particular in that it is particularly well suited as packaging material for oxidation-sensitive, moist and fatty objects, in particular foods, and can be used for the production of pouches by means of a heat sealing application. Furthermore, it is possible to dispense with adhesion promoter between the individual layers and there must be no barrier layers based on halogen-containing compounds, aluminium, $Al_2O_3$ and/or $SiO_2$.

A coated paper of this kind can also be produced relatively easily and with low application weights.

Hereinafter, the term "comprise" shall also mean "consist of".

The term "hydrophobic" refers to substances that cannot be mixed with water or that can only be wetted by water with the use of surfactants. The term "hydrophilic" refers to substances that can be mixed with water or that can be wetted by water without the use of surfactants. Hydrophobic polymers are also referred to as non-polar polymers and hydrophilic polymers are also referred to as polar polymers.

Hydrophobicity or hydrophilicity can be defined, for example, via the log P value. The n-octanol-water partition coefficient $K_{ow}$ (notations such as octanol/water partition coefficient are also common and correct) is a dimensionless partition coefficient known to a person skilled in the art which indicates the ratio of the concentrations of a chemical in a two-phase system formed of n-octanol and water and is thus a measure of the hydrophobicity or hydrophilicity of a substance. The log P value is the decadic logarithm of the n-octanol-water partition coefficient $K_{ow}$. The following is true here:

$$K_{ow} = P = \frac{c_0^{Si}}{c_w^{Si}} \text{ and } \log P = \log\frac{c_0^{Si}}{c_w^{Si}} = c_0^{Si} - c_w^{Si}$$

with $c_o^{Si}$=concentration of a chemical in the octanol-rich phase and $c_w^{Si}$=concentration of a chemical in the water-rich phase.

$K_{ow}$ is greater than one if a substance is more soluble in fat-like solvents, such as n-octanol, and less than one if it is more soluble in water. Accordingly, log P is positive for hydrophilic/lipophilic substances and negative for hydrophilic/lipophobic substances.

The base paper used in the coated paper according to the invention is not limited in principle.

Preferred embodiments of the invention will be described hereinafter:

A coated paper, wherein the first barrier layer contains or consists of substances which are selected from the group of lipophilic substances, paraffins, in particular hard paraffins, waxes, in particular microcrystalline waxes, waxes based on plant oils or fats, waxes based on animal oils or fats, plant waxes, animal waxes, low-molecular polyolefins, polyterpenes, and mixtures thereof.

A coated paper, wherein the transfer of substances, in particular of hydrophobic substances, is reduced or prevented by the second barrier layer.

A coated paper, wherein the transfer of substances, in particular of hydrophobic substances, from the first barrier layer or through the first barrier layer, into the third barrier layer or therebeyond is reduced or prevented.

A coated paper, wherein the transfer of substances, in particular of hydrophobic substances, from the third barrier layer or through the third barrier layer, into the first barrier layer is prevented.

A coated paper, wherein the transfer of substances which are selected from the group of lipophilic substances, paraffins, in particular hard paraffins, waxes, in particular microcrystalline waxes, waxes based on plant oils or fats, waxes based on animal oils or fats, plant waxes, animal waxes, low-molecular polyolefins, polyterpenes, and mixtures thereof, is reduced or prevented.

The transfer of these substances can be reduced or prevented in particular by a suitable type and quantity of the at least one hydrophilic polymer of the second barrier.

A coated paper, wherein the third barrier layer, apart from unavoidable or admissible impurities, is free from substances which are not permitted for direct contact with foods, in particular substances which are selected from the group of lipophilic substances, paraffins, in particular hard paraffins, waxes, in particular microcrystalline waxes, waxes based on plant oils or fats, waxes based on animal oils or fats, plant waxes, animal waxes, low-molecular polyolefins, polyterpenes, and mixtures thereof.

Hard paraffins, in particular of natural or synthetic origin, microcrystalline waxes, low-molecular polypropylene, natural waxes, low-molecular polyolefins, polyterpenes and mixtures thereof, are in particular those that are defined in BfR XXV of 1 Jun. 2019 (German Federal Institute for Risk Assessment (under the portfolio of the Federal Ministry of Food and Agriculture)) or in the various versions thereof.

Thus, the following is prevented: a) that these materials transfer into the third barrier layer and/or transfer outwardly from the third barrier layer, in particular into a contact material, in particular in contact with fat-containing foods and b) that, as a result of the reduction or prevention of the transfer of these substances, the barrier properties of the layers, in particular of the first, second and/or third barrier layer, are maintained or otherwise change or are completely lost as a result of a transfer, c) that substances transfer from the contact material into the first barrier layer and/or thus modify the first barrier layer.

It is preferred that the base paper has an area density of from 20 to 120 g/m$^2$, preferably of from 40 to 100 g/m$^2$.

It is further preferred that the paper has a composition with a long-fibre content of from 10 to 80%, preferably from 20 to 50%, and a short-fibre content of from 20 to 90 wt. %, preferably from 50 to 80 wt. %.

A long fibre is understood to mean a fibre with a fibre length of from 2.6 to 4.4 mm and a short fibre is understood to mean a fibre with a fibre length of from 0.7 to 2.2 mm.

In addition, 0 to 20%, preferably 0 to 5% of fillers, such as GCC (ground calcium carbonate), which for example is known under the trade names Hydrocarb 60 or Hydroplex 60, PCC (precipitated calcium carbonate), which for example is known under the trade name Precarb 105, natural kaolin and/or talc, and conventional auxiliaries, such as retention agents and/or sizing agents, may additionally be contained.

The term "base paper" used herein shall be understood to exclude cardboard and paperboard materials.

The advantage of such a base paper is, on the one hand, its high flexibility and, on the other hand, its good processing on existing packaging plants, the maintenance of the high machine availability, and the achievement of the necessary puncture resistance.

Common packaging machines are, for example, vertical and horizontal form-fill-seal machines for the production of stand-up pouches, flowpacks, pillowpacks, and others, machines that bring together two webs of the same of different materials and join them by heat sealing, for example also referred to as tray sealers, chamber belt machines (also with vacuum), pouch filling and sealing machines, thermoforming packaging machines, linear filling machines that apply lids by heat sealing to seal the packaging, wrapping machine with final heat-sealing step, blister packaging machines, and X-fold packaging machines.

The first barrier layer comprises at least one hydrophobic polymer. This barrier layer serves preferably as a barrier layer for water vapour and thus protects the packaged product against drying out. In the case of dry packaging contents, these are protected against moisture. In addition, it serves to protect the hydrophilic barrier against moisture from outside, since this can only provide its full effect in the dry state.

The at least one hydrophobic polymer preferably comprises a polymer based on a polyacrylate and/or a polyolefin, styrene-butadiene copolymer, polyvinyl acetate (also partly saponified), polyester, polyamide, polyurethane, polyether, polyethylene imine, and/or polyvinyl amide. Examples of suitable polymers are, in particular, poly(methyl acrylates), poly(methyl methacrylates), poly(ethyl acrylates), poly (ethyl methacrylates), poly(n-, iso-, tert.-)butyl acrylates, poly(n-, iso-, tert.-)butyl methacrylates, poly(cyclohexyl methacrylates), poly ethylhexyl acrylates and copolymers thereof, graft polymers, and copolymers with styrene, acrylonitrile, methylstyrene or vinyltoluene.

In addition to the hydrophobic polymer, a wax may also be provided. Suitable waxes comprise compounds such as mixtures or pure substances of fossil or natural short- to medium-chain hydrocarbons, their acids, esters, amides and diamides, which are referred to colloquially as "waxes". Suitable waxes are, for example, heneicosane, docosane, tricosane, tetracosane, pentacosane, hexacosane, heptacosane, octacosane, nonacosane, triacontane, hentriacontane, dotriacontane, tritriacontane, tetratriacontane, pentatriacontane, hexatriacontane, heptatriaontane, octatriacontane, nonatriacontane; Montan waxes, natural waxes (carnauba wax, beeswax, Candelilla wax), waxes produced by hydrogenation or partial hydrogenation of plant oils and animal oils or fats, and metal soaps, such as Ca stearate.

Suitable polymers and polymer/wax mixtures are known in particular under the trade names CHT Coat 230, Vapor Coat 2200, Vapor Coat 1300, BimBA 8510, BimBA 8888, Cartaseal VWF, Cartaseal SWF, Sealcoat SL251, Rhobarr 320, B-Coat SP1, B-Coat WB 100, B-Coat 50/3, Chemipearl S300, Ultraseal W-951, Ultraseal W-952, Ukaphob HR 530, Induprint SE 2555, Wükoseal 630, Extomine BG-EM 52%, EurikaCoat 3624, Aquacer 1061 and Epotal SP 106.

The at least one hydrophobic polymer is contained in the first barrier layer preferably in an amount of from 1 to 100 wt. %, particularly preferably of from 50 to 99.5 wt. %, or 50 to 100 wt. %, in relation to the total weight of the first barrier layer.

The first barrier layer as a whole is preferably hydrophobic.

The first barrier layer may also contain additives such as thickeners, for example acrylate-based thickeners, surfactants, for example sulfosuccinates, extensional rheology aids, for example polyacrylamides, carboxymethyl celluloses, polyvinyl alcohols, and/or crosslinking agents, such as aldehydes and polyvalent aldehydes, zirconates, polyvalent epoxides, epichlorohydrin resins and/or hydracides.

These additives are preferably contained in each case in an amount of from 0.1 to 1 wt. %, in relation to the total weight of the first barrier layer.

The applied amount of the first barrier layer is preferably 1 to 20 g/m$^2$ and particularly preferably 5 to 10 g/m$^2$. The amount relates to the dried first barrier layer in the final product.

The second barrier layer comprises at least one hydrophilic polymer. This barrier layer serves preferably as a barrier layer for oxygen and thus protects the packaged product against oxidation.

The hydrophilic polymer preferably comprises a polymer based on a polyvinyl alcohol. Examples of suitable polymers are, in particular, polymers based on vinyl alcohol or copolymers of ethylene and vinyl alcohols.

Suitable polymers are known in particular under the trade names Exceval AQ 4104, Exceval HR 3010, Sealcoat HS 25 and MichemFlexB 1001.

The at least one hydrophilic polymer is contained in the second barrier layer preferably in an amount of from 1 to 100 wt. %, particularly preferably of from 50 to 99.5 wt. %, or 50 to 100 wt. %, in relation to the total weight of the second barrier layer.

The second barrier layer as a whole is preferably hydrophilic.

The second barrier layer may also contain additives such as thickeners, for example acrylate-based thickeners, surfactants, for example sulfosuccinates, extensional rheology aids, and/or crosslinking agents, such as aldehydes and polyvalent aldehydes, zirconates, polyvalent epoxides, epichlorohydrin resins and/or hydracides.

These additives are preferably contained in each case in an amount of from 0.1 to 1 wt. %, in relation to the total weight of the second barrier layer.

The applied amount of the second barrier layer is preferably 1 to 20 g/m$^2$ and particularly preferably 1 to 10 g/m$^2$. The amount relates to the dried second barrier layer in the final product.

The third barrier layer comprises at least one hydrophobic polymer. This barrier layer serves preferably as a barrier layer for water vapour and thus protects the packaged product against drying out. In the case of dry packaging contents, these are protected against moisture. In addition, it serves to protect the hydrophilic barrier against moisture from inside, since this can only provide its full effect in the dry state.

The at least one hydrophobic polymer contained in the third barrier layer is preferably a thermoplastic polymer, and so the layer is thus heat-sealable.

The coated paper according to the invention is therefore characterised in a further preferred embodiment in that the third barrier layer is heat-sealable. For this purpose, the third barrier layer preferably comprises at least one thermoplastic polymer.

The coated paper according to the invention preferably has a sealed-seam strength of from 1.5 N/15 mm to 10 N/15 mm, wherein the sealed-seam strength was determined for the coated paper as follows:

The coated paper was sealed at 3.3 bar for 0.3 seconds in a temperature range of from 100° C. to 200° C. transversely to the direction of the paper web and the sealed-seam strength was determined in accordance with DIN 55529 (2012).

The term "heat sealing" is preferably understood to mean the connection of two layers of the coated paper by means of local heat application.

The at least one hydrophobic polymer preferably comprises a polymer based on a polyacrylate and/or a polyolefin, styrene-butadiene copolymer, polyvinyl acetate (also partly saponified), polyester, polyamide, polyurethane, polyether, polyethylene imine, and/or polyvinyl amide. Examples of suitable polymers are, in particular, poly(methyl acrylates), poly(methyl methacrylates), poly(ethyl acrylates), poly (ethyl methacrylates), poly(n-, iso-, tert.-)butyl acrylates, poly(n-, iso-, tert.-)butyl methacrylates, poly(cyclohexyl methacrylates), poly ethylhexyl acrylates and copolymers thereof, graft polymers, and copolymers with styrene, acrylonitrile, methylstyrene or vinyltoluene.

In addition to the hydrophobic polymer, a wax may also be provided. Suitable waxes comprise compounds such as mixtures or pure substances of fossil or natural short- to medium-chain hydrocarbons, their acids, esters, amides and diamides, which are referred to colloquially as "waxes". Suitable waxes are, for example, heneicosane, docosane, tricosane, tetracosane, pentacosane, hexacosane, heptacosane, octacosane, nonacosane, triacontane, hentriacontane, dotriacontane, tritriacontane, tetratriacontane, pentatriacontane, hexatriacontane, heptatriaontane, octatriacontane, nonatriacontane; Montan waxes, natural waxes (carnauba wax, beeswax, Candelilla wax), waxes produced by hydrogenation or partial hydrogenation of plant oils and animal oils or fats, and metal soaps, such as Ca stearate.

Suitable polymers and polymer/wax mixtures are known in particular under the trade names Vapor Coat 1300, BimBA 8888, Cartaseal SWF, Sealcoat SL251, Rhobarr 320, B-Coat SP1, B-Coat WB 100, B-Coat 50/3, Chemipearl S300, Ultraseal W-951, Ultraseal W-952, Wükoseal 630, EurikaCoat 3624 and Epotal SP 106.

The at least one hydrophobic polymer is contained in the third barrier layer preferably in an amount of from 1 to 100 wt. %, particularly preferably of from 50 to 100 wt. %, or 50 to 99.5 wt. %, in relation to the total weight of the third barrier layer.

The third barrier layer as a whole is preferably hydrophobic.

The third barrier layer may also contain additives, such as thickeners, for example acrylate-based thickeners, surfactants, for example sulfosuccinates, extensional rheology aids, for example acrylate-based extensional rheology aids, waxes, such as fatty acids or fatty-acid-amide-based waxes, additives for reducing the sensitivity to wear and increasing slip, such as phyllosilicates, in particular magnesium silicate hydrates or aluminosilicates, and/or crosslinking agents, such as aldehydes and polyvalent aldehydes, zirconates, polyvalent epoxides, epichlorohydrin resins and/or hydracides.

These additives are preferably contained in each case in an amount of from 0 to 50 wt. %, preferably from 0 to 30 wt. %, in relation to the total weight of the third barrier layer.

The applied amount of the third barrier layer is preferably 1 to 20 g/m$^2$ and particularly preferably 5 to 10 g/m$^2$. The amount relates to the dried third barrier layer in the final product.

In a particular embodiment, if the packaged content contains fats in addition to water, the third barrier layer should not contain any low-molecular, fat-soluble constituents, apart from minimal amounts which are permitted for the contact with fatty foods. Waxes are thus largely ruled out for improving the water vapour barrier, and polymer systems must be used, which form acceptable water vapour barriers even without waxes and in an ideal scenario are heat-sealable. Suitable for this purpose are, for example, copolymers of non-polar monomers, such as ethylene with acrylic acid and other ethylenically unsaturated carboxylic acids which also have a certain grease barrier in addition to the water vapour barrier. Known products are, for example, Cartaseal SWF, Wükoseal 630 and Sealcoat SL 251.

The first barrier layer may, however, contain waxes, since the second barrier layer with its function as oxygen, grease and mineral oil barrier also forms an excellent barrier against waxes, which generally have a strong non-polar character.

In a further preferred embodiment of the coated paper according to the invention, a pre-coat comprising at least one inorganic pigment and a polymer binder is provided between the base paper and the first barrier layer.

The inorganic pigment comprises in particular a silicate, preferably a phyllosilicate, and very particularly preferably a kaolin.

The polymer binder preferably comprises a polymer binder based on a polyacrylate.

Examples of suitable polymer binders are, in particular, acrylate-based or styrene-/butadiene-based binders. In principle, all polymers that can be used as binders for pigment coatings in the paper industry are suitable. Starch-based binders are also possible.

Suitable polymer binders are known in particular under the trade names Acronal 305S, Ligos K 4079, Acronal S 728, XZ94346.01, XZ94346.00.

The precoat preferably contains 1 to 70 wt. %, preferably 5 to 50 wt. %, of polymer binder. The amount relates to the dried precoat in the final product.

The precoat further preferably contains 50 to 95 wt. %, preferably 80 to 90 wt. %, of inorganic pigment. The amount relates to the dried precoat in the final product.

In addition, the precoat may contain additives, such as thickeners, for example acrylate-based thickeners, surfactants, and/or rheology modifiers. The use of crosslinkers is also conceivable. Preferably, the precoat contains a zirconium-based crosslinker and is itself crosslinked with formaldehyde.

These additives are preferably contained in each case in an amount of from 0 to 2 wt. %. The amount relates to the dried precoat in the final product.

The applied amount of the precoat is preferably 1 to 10 g/m$^2$ and particularly preferably 2 to 6 g/m$^2$. The amount relates to the dried precoat in the final product.

If such a precoat (also called a primer) is applied, this has the advantage for example that the paper surface is sealed and the further barrier layers coated on top of it do not migrate into the paper. Furthermore, this precoat reduces the average roughness depth of the base paper and offers an advantageous "holdout", which is distinguished by an application covering the entire surface and by a defined surface energy, so that an applied barrier layer can form optimally. In addition, the precoat mediates the ply adhesion between the base paper and the barrier layers, which may be important for subsequent sealing applications.

The coated paper according to the invention is characterised in a further preferred embodiment in that a sealing layer comprising at least one thermoplastic polymer is provided on the third barrier layer.

Such a sealing layer is expedient in particular if the at least one hydrophobic polymer in the third barrier layer does not comprise thermoplastic polymer, that is to say is not heat-sealable.

The sealing layer preferably comprises a thermoplastic polymer based on a polyacrylate, a styrene/butadiene copolymer and/or a polyolefin.

Examples of suitable polymers are, in particular, acrylates, poly (meth acrylates), poly(methyl acrylates), poly (methyl methacrylates), poly(ethyl acrylates), poly(ethyl methacrylates), poly(n-, iso-, tert.-)butyl acrylates, poly(n-, iso-, tert.-)butyl methacrylates, poly(cyclohexyl methacrylates), poly ethylhexyl acrylates and copolymers thereof, graft polymers, and copolymers with styrene, acrylonitrile, methylstyrene or vinyltoluene.

Suitable polymers are known in particular under the trade names Vapor Coat 1300, BimBA 8888, Cartaseal SWF, Rhobarr 320, B-Coat WB 100, B-Coat 50/3, Chemipearl S300, Ultraseal W-952, Wükoseal 630, EurikaCoat 3624, Epotal SP 106, Hypod 2000, Extomine BS-OF 40%, Aquaseal X2200, Cartaseal SCR, CHT Coat 8080, Sealcoat MB46HE and Extomine BG-EM 48%

The at least one thermoplastic polymer is contained in the sealing layer preferably in an amount of from 1 to 100 wt. %, particularly preferably of from 70 to 100 wt. %, or of from 70 to 99.5 wt. %, in relation to the total weight of the sealing layer.

The sealing layer may also contain additives, such as thickeners, for example acrylate-based thickeners, surfactants, for example sulfosuccinates, extensional rheology aids, for example acrylate-based extensional rheology aids, waxes, additives for reducing the sensitivity to wear and increasing slip, such as phyllosilicates, in particular magnesium silicate hydrates or aluminosilicates, and/or crosslinking agents.

These additives are preferably contained in each case in an amount of from 0 to 50 wt. %, preferably from 0 to 30 wt. %, in relation to the total weight of the sealing layer.

The applied amount of the precoat is preferably 1 to 10 g/m$^2$ and particularly preferably 1 to 5 g/m$^2$. The amount relates to the dried sealing layer in the final product.

The coated paper according to the invention preferably has a sealed-seam strength of from 1.5 N/15 mm to 10 N/15 mm, wherein the sealed-seam strength was determined for the coated paper as follows:

The coated paper was sealed at 3.3 bar for 0.3 seconds in a temperature range of from 100° C. to 200° C. transversely to the direction of the paper web and the sealed-seam strength was determined in accordance with DIN 55529 (2012).

The coated paper according to the invention is preferably characterised in that no adhesion promoter is used between the individual barrier layers. Adhesion promoters are understood here in particular to mean substances that are applied between the individual barrier layers in order to ensure or increase the adhesion of the particular barrier layers to one another.

The coated paper according to the invention is additionally preferably characterised in that the coated paper is free from halogen-containing compounds. In particular, the three barrier layers are free from halogen-containing compounds. In addition, the precoat and/or the sealing layer are likewise free from halogen-containing compounds.

The coated paper according to the invention is also characterised in that the coated paper does not comprise any aluminium, $Al_2O_3$ and/or $SiO_2$ layer, in particular does not comprise aluminium, $Al_2O_3$ and/or $SiO_2$ as pure substances.

The coated paper according to the invention is also characterised in that the first, second and/or third barrier layer do not comprise any aluminium, $Al_2O_3$ and/or $SiO_2$ layer, and/or does not comprise aluminium, $Al_2O_3$ and/or $SiO_2$, in particular not as pure substances.

Furthermore, the sealing layer is preferably characterised in that it does not contain or consist of any aluminium, $Al_2O_3$ and/or $SiO_2$, in particular not as pure substances.

The coated paper according to the invention can be obtained using known production methods.

It is preferred, however, to obtain the recording material according to the invention by a method in which aqueous suspensions comprising the starting materials of the first, second and third barrier layer are applied successively to the base paper, the aqueous application suspensions having a solids content of from 10 to 60 wt. %, preferably from 30 to 50 wt. %, and being applied by means of the curtain coating process at an operating speed of the coating plant of at least 200 m/min.

This method is particularly advantageous from an economic point of view and due to the even application over the paper web.

If the value of the solids content falls below about 10 wt. %, then the economic efficiency deteriorates, since a large amount of water has to be removed by gentle drying in a short space of time, which has a detrimental effect on the coating speed. On the other hand, if the value of 60 wt. % is exceeded, then this only leads to an increased technical effort to ensure the stability of the coating curtain material during the coating process and the drying of the applied film, since the machine has to run very quickly again in this case.

In the curtain coating process, a free-falling curtain of a coating dispersion is formed. The coating dispersion, which is in the form of a thin film (curtain), is "poured" by free fall onto a substrate in order to apply the coating dispersion to the substrate. Document DE 10 196 052 T1 discloses the use of the curtain coating process in the production of information recording materials, wherein multi-layer recording layers are realised by applying the curtain, consisting of a plurality of coating dispersion films, to substrates.

Embodiments of the method according to the invention in which a "double curtain" is used are also conceivable. This means that two successive barrier layers are applied immediately successively. The application is performed here immediately successively so that the first applied layer has not yet dried before the second barrier layer is applied. The two layers are thus preferably applied "wet-on-wet".

All definitions in relation to the curtain coating process apply similarly for the double curtain coating process.

The method according to the invention is preferably characterised in that the first and second or the second and third barrier layer are applied immediately successively wet-on-wet by means of a double curtain coating process.

The advantage of a wet-on-wet application by means of a double curtain coating process is that the two barrier layers have a stronger connection and in particular it is possible to dispense with an adhesion promoter arranged in between.

In a preferred embodiment of the method according to the invention, the aqueous deaerated application suspension has a viscosity of about 100 to about 800 mPas (Brookfield, 100 rpm, 20° C.). If the viscosity falls below the value of about 100 mPas or exceeds the value of about 800 mPas, this leads to poor runnability of the coating medium at the coating unit. The viscosity of the aqueous deaerated application suspension is particularly preferably about 200 to about 500 mPas. The viscosities of successive coating media in the double curtain process should decrease from bottom to top. In the event of incorrectly set coatings, the likelihood of the formation of a heel at the point where the curtain contacts increases, as does the occurrence of "wetting defects".

In a preferred embodiment, the surface tension of the aqueous coating suspension can be set to about 25 to about 70 mN/m, preferably to about 35 to about 60 mN/m (measured according to the standard for bubble pressure tensiometry (ASTM D 3825-90), as described below), to optimise the process. Better control over the coating process is obtained by determining the dynamic surface tension of the coating material and adjusting it in a targeted manner by selecting the appropriate surfactant and by determining the required amount of surfactant.

The dynamic surface tension is measured by means of a bubble pressure tensiometer. The maximum internal pressure of a gas bubble formed via a capillary in a liquid is measured. The internal pressure p of a spherical gas bubble (Laplace pressure) depends on the radius of curvature r and the surface tension σ according to the Young-Laplace equation:

$$p = \frac{2\sigma}{r}$$

If a gas bubble is created at the tip of a capillary in a liquid, the curvature first increases and then decreases again, resulting in a pressure maximum. The greatest curvature and thus the greatest pressure occur when the radius of curvature is equal to the capillary radius.

Pressure Curve During Bubble Pressure Measurement, Position of the Pressure Maximum:

The radius of the capillary is determined with a reference measurement, which is carried out with a liquid of known surface tension, usually water. If the radius is then known, the surface tension can be calculated from the pressure maximum pmax. Since the capillary is immersed in the liquid, the hydrostatic pressure p0, which results from the immersion depth and the density of the liquid, must be subtracted from the measured pressure (this is done automatically in the case of modern measuring instruments). This results in the following formula for the bubble pressure method:

$$\sigma = \frac{(\rho_{max} - \rho_0) \cdot r}{2}$$

The measured value corresponds to the surface tension at a certain surface age, the time from the beginning of bubble formation to the occurrence of the pressure maximum. By varying the speed at which the bubbles are generated, the dependence of the surface tension on the surface age can be recorded, resulting in a curve in which the surface tension is plotted over time.

This dependence plays an important role for the use of surfactants, since the equilibrium value of the interfacial tension is not reached at all in many processes due to the sometimes low diffusion rates and adsorption rates of surfactants.

Successive coating media in a double curtain should have decreasing surface tensions from bottom to top, since otherwise wetting defects may occur. Intersecting surface tension curves may also work, provided the difference is only small, however, this is not preferred.

The individual barrier layers can be formed on-line or in a separate coating process off-line.

In further embodiments, the individual barrier layers can also be applied to the base paper using the following methods:

Individual barrier layers can be applied to the base paper and/or to pre-existing other barrier layers by means of printing methods.

Individual barrier layers can be applied to the base paper and/or to pre-existing other barrier layers by means of multiple extrusion (from 3 to 4 different polymer melts).

This technique has the advantage that significantly more barrier material can thus be applied, but this is only of interest if the overall product does not need to be recyclable as paper. Disadvantages, on the other hand, are lower application speeds, higher energy consumption, and a higher minimum application weight.

Individual barrier layers can be applied by laminating paper, for example in the form of plastics material films applied to the base paper and/or to pre-existing other barrier layers.

Individual barrier layers can also be applied successively over multiple application steps. For this purpose, for coating over, it may be that an increase of the surface energy of a dried coating is necessary by way of various processes. These processes include, for example, corona or plasma treatments as well as flame treatment, UV treatment or chemical activation processes.

In other embodiments, the method according to the invention is preferably characterised in that individual barrier layers are not applied by means of vapour deposition of metals or metal oxides to the base paper and/or to pre-existing other barrier layers.

Any combinations of the above-described methods are also possible.

The present invention further relates to a coated paper obtainable by the methods described above.

The present invention also relates to the use of a coated paper as described above or of a coated paper obtainable by the method described above as a packaging material.

Lastly, the present invention also relates to the use of a coated paper as described above or of a coated paper obtainable by the method described above as a packaging material for foods, in particular for fatty and oxidation-sensitive foods, such as meat and milk products.

In a further preferred embodiment of the invention, the coated paper according to the invention is applied to cardboard or paperboard, in particular by lamination or bonding.

Lastly, the present invention also relates to the use of a composite in which a coated paper according to the invention is applied to cardboard or paperboard, in particular by lamination or bonding, as a packaging material for foods, in particular for fatty and oxidation-sensitive foods, such as meat and milk products.

In this way, packaging materials can be produced in a simple and economical way that have the advantages of both material components, such as the increased strength and stiffness of cardboard or paperboard compared to a coated paper and the described advantages of the coated papers. The application can be performed, for example, using starch.

Preferably, the coated paper is therefore a component of packaging materials based on cardboard or paperboard.

With these packaging materials according to the invention, heavier foods in particular, such as meat, fish or cheese, can be safely packaged and attractively presented to the customer in the form of upright packaging in retail outlets.

These packaging materials preferably have a mass fraction of greater than 95 wt. % of the uniform material type paper, cardboard or paperboard. Here, a further advantage of the present invention is that these packaging materials according to the invention are not composite packaging according to § 3 (5) of the German Packaging Act, and thus this embodiment of the present invention contributes significantly to reducing the impact of packaging waste on the environment.

The invention is explained in detail below on the basis of non-limiting examples.

The materials described in the description and used in the examples are summarised in the following table with their trade names and the associated manufacturers.

| Product | Manufacturer |
|---|---|
| Acroflex VX559 | CTP GmbH |
| Acronal 305S | BASF SE |
| Acronal S728 | BASF SE |
| Aerosol OT 70 PG | Solvay Chemicals |
| Aquacer 1061 | BYK-Chemie GmbH |
| Aquaseal X2200 | Paramelt B.V. |
| Aquaseal X2258 | Paramelt B.V. |
| Auerzirc PZCS20 | Lehmann & Voss & Co. KG |
| B-Coat 50/3 | Polycoating GmbH |
| B-Coat SP1 | Polycoating GmbH |
| B-Coat WB100 | Polycoating GmbH |
| BimBA 8510 | BIM Kemi GmbH |
| BimBA 8888 | BIM Kemi GmbH |
| Capim NP | Imerys Minerals GmbH |
| Cartaseal SCR | Archroma Distribution and Management Germany GmbH |
| Cartaseal SWF | Archroma Distribution and Management Germany GmbH |
| Cartaseal VWF | Archroma Distribution and Management Germany GmbH |
| Chemipearl S300 | Mitsui Chemicals Europe GmbH |
| CHT Coat 230 | CHT Germany GmbH |
| CHT Coat 8080 | CHT Germany GmbH |
| Epotal SP 106 | BASF SE |
| EurikaCoat 3624 | Eurikas |

-continued

| Product | Manufacturer |
|---|---|
| Exceval AQ4104 | Kuraray Europe GmbH |
| Exceval HR 3010 | Kuraray Europe GmbH |
| Extomine BG-EM 48% | Omya GmbH |
| Extomine BG-EM 52% | Omya GmbH |
| Extomine BS-OF 40% | Omya GmbH |
| Genapol PF 10 | Clariant AG |
| Hypod 2000 | The DOW Chemical Company |
| Induprint SE2555 | Indulor Chemie GmbH |
| Ligos K4079 | Trinseo Deutschland Anlagengesellschaft mbH |
| Metolat 368 | Münzing Chemie GmbH |
| Michem Flex B 1001 | Michelman SARL |
| Rhobarr 320 | The DOW Chemical Company |
| Sealcoat HS 25 | baumeister - Chemicals & consulting Gmbh & Co. KG |
| Sealcoat MB46HE | baumeister - Chemicals & consulting Gmbh & Co. KG |
| Sealcoat SL 251 | baumeister - Chemicals & consulting Gmbh & Co. KG |
| Sterocoll DF3 | BASF SE |
| Ukaphob HR 530 | Schill + Seilacher GmbH |
| Ultraseal W-951 | keim additec surface GmbH |
| Ultraseal W-952 | keim additec surface GmbH |
| VaporCoat 1300 | Michelman SARL |
| VaporCoat 2200 | Michelman SARL |
| Wükoseal 630 | Münzing Chemie GmbH |
| XZ 94246.00 | Trinseo Deutschland Anlagengesellschaft mbH |
| XZ 94246.01 | Trinseo Deutschland Anlagengesellschaft mbH |

EXAMPLES

The following coatings were applied to a 60 g/m$^2$ base paper with 40% long fibre and 60% short fibre content.

Precoat/Primer:

The precoat contains 75.9% pigment (Capim NP), 22.8% latex (Ligos K4079) and 1.3% rheology modifiers (0.2% Acroflex VX559, 1.1% Auerzirc PZCS20).

Barrier Layer 1:

V1+V2: The first barrier layer comprises 99.05% styrene/butadiene copolymer (CHT Coat 230) and 0.95% rheology modifiers (0.1% Sterocoll DF3; 0.15% Acroflex VX559; 0.7% Aerosol OT 70 PG).

V3+V4+V5: The first barrier layer comprises 99.3% polymer (BimBA 8510) and 0.7% rheology modifiers (0.7% Aerosol OT 70 PG)

Barrier Layer 2:

The second barrier layer comprises 99.5% polyvinyl alcohol which was mixed with glyoxal (V1+2: MFB 1000; V3: MFB 1001). The remaining 0.5% comprise rheology modifiers (0.1% Sterocoll DF3; 0.4% Aerosol OT 70 PG).

Barrier Layer 3:

V1+V2+V3: The third barrier layer comprises 98.74% styrene/butadiene copolymer (Ultraseal W-952) and 1.26% rheology modifiers (0.08% Sterocoll DF3; 0.69% Acroflex VX559; 0.49% Aerosol OT 70 PG).

V4+V5: The third barrier layer comprises 97.74% ethylene/acrylic acid copolymer (Wükoseal 630) and 2.26% rheology modifiers (0.18% Sterocoll DF3, 0.08% Acroflex VX559, 0.25% Aerosol OT 70 PG, 1.66% Metolat 368, 0.10% Genapol PF10).

For this purpose, the precoat was applied using a blade. The first and second barrier layer were applied in a double curtain process. The third barrier layer was applied as a single curtain.

| Structure | Application method | Unit | V1 | V2 | V3 | V4 | V5 |
|---|---|---|---|---|---|---|---|
| Base paper | Paper machine | g/m$^2$ | 60 | 60 | 60 | 60 | 60 |
| Precoat/primer | Coating machine - blade | g/m$^2$ | 4 | 4 | 4 | 4 | 4 |
| Barrier layer 1 | Coating machine - double curtain | g/m$^2$ | 10 | 10 | 10 | 10 | 10 |
| Barrier layer 2 | Coating machine - double curtain | g/m$^2$ | 5 | 5 | 5 | 5 | 5 |
| Barrier layer 3 | Coating machine - curtain | g/m$^2$ | 5 | 10 | 5 | 10 | 5 |
| WVTR | | | | | | | |
| 38° C., 90% r.h. | | g/m$^2$/d | 41.6 | 17.8 | 27.1 | 37.2 | 45.6 |
| 23° C., 85% r.h. | | g/m$^2$/d | 12.3 | 9.3 | 5.1 | 12.8 | 15.6 |
| 23° C., 50% r.h. | | g/m$^2$/d | 2.2 | 1.7 | n.d. | n.d. | n.d. |
| OTR | | | | | | | |
| 0% rel. humidity | | cm$^3$/m$^2$/d | <2 | <2 | <2 | <2 | <2 |
| 80% r.h., 23° C. | | cm$^3$/m$^2$/d | 17 | 4 | n.d. | n.d. | n.d. |
| HVTR | | g/m$^2$/d | <10 | <10 | <10 | <10 | <10 |
| Palm kernel oil test | Test condition II | | | | | | |
| Display paper | d < 1 mm | — | 0 | 0 | n.d. | 0 | 0 |
| Display paper | d > 1 mm | — | 0 | 0 | n.d. | 0 | 0 |
| Test paper | d < 1 mm | — | 0 | 0 | n.d. | 0 | 0 |
| Test paper | d > 1 mm | — | 0 | 0 | n.d. | 0 | 0 |

-continued

| Structure | Application method | Unit | V1 | V2 | V3 | V4 | V5 |
|---|---|---|---|---|---|---|---|
| Sealed-seam strength | | | | | | | |
| optim. sealing force - transverse | | N/15 mm | 5.2 | 7.1 | 4.8 | 5.4 | 3.5 |
| optim. sealing temperature - transverse | | ° C. | 140 | 150 | 150 | 100 | 100 |

WVTR: Water vapour transmission rate, determined according to ISO 15106-2.

OTR: Oxygen transmission rate, determined according to DIN 53380-2 (0% rel. humidity, 23° C.), ISO 15105-2 (80% r.h., 23° C.).

HVTR: Hexane vapour transmission rate. Here, hexane is filled into a beaker (solvent-resistant), tightly sealed with the test sample, and the decrease in weight is monitored over time.

Palm kernel oil test: Analogous to DIN 53116.

Display paper: Evaluation of the display paper mentioned in DIN 53116. Here, grease penetration points with a diameter (d) >/<1 mm are counted.

Test paper: Evaluation of the rear side of the test sample from DIN 53116. Here, grease penetration points with a diameter (d) >/<1 mm are counted.

Sealed-seam strength: The samples are sealed at 3.3 bar for 0.3 seconds in the temperature range of from 100° C. to 200° C., transverse to the running direction of the paper, and the sealed-seam strength is determined according to DIN 55529 (2012).

n.d. not determined

The coated papers according to the invention were compared with commercially obtainable papers (see tables below).

| Paper | | | V1 | V2 | V3 | V4 | V5 | Algro Guard OHG | Algro Finess/ PET | Algro Finess/ PET met | Seal Silk |
|---|---|---|---|---|---|---|---|---|---|---|---|
| Manufacturer | | | | | | | | Sappi | Sappi | Sappi | Sappi |
| Area density | | $g/m^2$ | 84 | 89 | 84 | 89 | 84 | 93 | 71 | 70 | 70 |
| Observations | | | | | | Without wax in the third barrier layer | | contains PVDC | | metallised | |
| WVTR | | | | | | | | | | | |
| 38° C., 90% r.h. | | $g/m^2/d$ | 41.6 | 17.8 | 27.1 | 27.1 | 37.2 | 1.7 | 22.3 | 1.1 | >500 |
| 23° C., 85% r.h. | | $g/m^2/d$ | 12.3 | 9.3 | 5.1 | 5.1 | 12.8 | n.d. | n.d. | n.d. | n.d. |
| 23° C., 50% r.h. | | $g/m^2/d$ | 2.2 | 1.7 | n.d. | n.d. | n.d. | 0.12 | n.d. | 0.37 | 17.1 |
| OTR | | | | | | | | | | | |
| 0% rel. humidity | | $cm^3/m^2/d$ | <2 | <2 | <2 | <2 | <2 | <2 | >20000 | 2.5 | >20000 |
| 80% r.h., 23° C. | | $cm^3/m^2/d$ | 17 | 4 | n.d. | n.d. | n.d. | n.d. | n.d. | n.d. | n.d. |
| HVTR | | $g/m^2/d$ | <10 | <10 | <10 | <10 | <10 | <10 | 938 | <10 | 655 |
| Palm kernel oil test | Test condition II | | | | | | | | | | |
| Display paper | d < 1 mm | — | 0 | 0 | n.d. | 0 | 0 | n.d. | n.d. | n.d. | n.d. |
| Display paper | d > 1 mm | — | 0 | 0 | n.d. | 0 | 0 | n.d. | n.d. | n.d. | n.d. |
| Test paper | d < 1 mm | — | 0 | 0 | n.d. | 0 | 0 | n.d. | n.d. | n.d. | n.d. |
| Test paper | d > 1 mm | — | 0 | 0 | n.d. | 0 | 0 | n.d. | n.d. | n.d. | n.d. |
| Sealed-seam strength | | | | | | | | | | | |
| optim. sealing force - transverse | | N/15 mm | 5.2 | 7.1 | 4.8 | 5.4 | 3.5 | 4.9 | 6.4 | n.d. | 3.9 |
| optim. sealing temperature - transverse | | ° C. | 140 | 150 | 150 | 100 | 100 | 140 | 120 | n.d. | 130 |

| | | | Barricote BAG WG | ShieldPlus "1" | ShieldPlus "2" | ShieldPlus "3" | ShieldPlus "4" |
|---|---|---|---|---|---|---|---|
| Manufacturer | | | Mitsubishi | Nippon Paper | Nippon Paper | Nippon Paper | Nippon Paper |
| Area density | | $g/m^2$ | 83 | n.d. | 136 | 66 | 66 |
| Observations | | | | PE-coated | white | white | brown |
| WVTR | | | | | | | |
| 38° C., 90% r.h. | | $g/m^2/d$ | 72.2 | 24.4 | 33.3 | 43.0 | 33.1 |
| 23° C., 85% r.h. | | $g/m^2/d$ | n.d. | n.d. | n.d. | n.d. | n.d. |
| 23° C., 50% r.h. | | $g/m^2/d$ | 8.1 | n.d. | n.d. | n.d. | n.d. |
| OTR | | | | | | | |
| 0% rel. humidity | | $cm^3/m^2/d$ | n.d. | >20000 | 2000 | >20000 | 13900 |
| 80% r.h., 23° C. | | $cm^3/m^2/d$ | n.d. | n.d. | n.d. | n.d. | n.d. |
| HVTR | | $g/m^2/d$ | n.d. | n.d. | <10 | <10 | <10 |
| Palm kernel oil test | Test condition II | | | | | | |
| Display paper | d < 1 mm | — | n.d. | n.d. | n.d. | n.d. | n.d. |

-continued

| | | | Barricote BAG WG | ShieldPlus "1" | ShieldPlus "2" | ShieldPlus "3" | ShieldPlus "4" |
|---|---|---|---|---|---|---|---|
| Display paper | d > 1 mm | — | n.d. | n.d. | n.d. | n.d. | n.d. |
| Test paper | d < 1 mm | — | n.d. | n.d. | n.d. | n.d. | n.d. |
| Test paper | d > 1 mm | — | n.d. | n.d. | n.d. | n.d. | n.d. |
| Sealed-seam strength | | | | | | | |
| optim. sealing force - transverse | | N/15 mm | 3.5 | 3.5 | n.d.* | n.d.* | n.d.* |
| optim. sealing temperature - transverse | | ° C. | 140 | 140 | n.d.* | n.d.* | n.d.* |

*not sealable according to the manufacturer

Examples V4 and V5

V4:

V3+that the third barrier layer, apart from unavoidable or admissible impurities, is free from substances which are not permitted for direct contact with foods, in particular substances which are selected from the group of paraffins, in particular hard paraffins, waxes, in particular microcrystalline waxes, low-molecular polyolefins, polyterpenes, and mixtures thereof, and waxes obtained from plants or animals or waxes produced from plant oils/fats or animal oils/fats.

V5:

Analogously to V4, but half the application weight of the third barrier layer.

Algro Guard OHG: The material has a precoat based on aluminium silicate and, applied thereto, a PVDC coating 8 μm thick. The permeabilities to oxygen and hexane are similar to examples V1 to V3 according to the invention; the permeability to water vapour is even slightly better. The obtained sealing force lies in the range of the examples according to the invention. However, it is considered to be a large disadvantage that the material contains PVDC as barrier medium. This is unjustifiable from ecological viewpoints.

Algro Finess/PET: This is a paper that has been coated with 20 μm PE/PET. An acrylate-co-acrylonitrile was used as adhesion promoter or precoat.

The water vapour permeability and sealing force are comparable to the examples according to the invention, however, the hexane and oxygen permeability are very high.

Algro Finess/PETmet: The material is a paper coated with metallised PE or PET. This naturally has very good barriers on account of the metallisation. The main difference from the examples according to the invention is the metallisation considered to be highly disadvantageous from an economic and ecological viewpoint.

Barricote BAG WG: The material initially has a clay-containing precoat and then a functional coating with poly(ethylene-co-acrylic acid). The water vapour permeability lies between 1.7 and 4 times examples V1 to V3; the sealing force is also at the same level as "Shieldplus 1" and thus 27-50% lower than in the examples according to the invention.

SealSilk: The SealSilk is constructed similarly to the Barricote BAG WG. Here, a coat of GCC with styrene/butadiene latex was initially applied, to which a poly (ethylene-co-acrylic acid) dispersion was then applied. The sealing force of this material was still about 1 N/15 mm below that of examples V1 to V3 according to the invention. All transmission rates (WVTR, OTR, HVTR) are far below those of the examples according to the invention.

ShieldPlus 1: The material "ShieldPlus 1" has a simple PE coating. At 3.5 N/15 mm, this seals 27 to 50% less strongly than the examples according to the invention. Furthermore, the oxygen permeability of the material is very high. The hexane permeability of the material was not examined, but is not expected to be particularly high. The water vapour barrier is good, which is clearly attributable to the PE.

"ShieldPlus 2-4" The "ShieldPlus 2-4" consist of a styrene/butadiene coat and a PVOH coat; in addition, one or both coats contains clay. The water vapour and hexane permeability of these materials is in the range of the examples according to the invention (WVTR between V3 and V1), however, the oxygen permeability is very high and the materials are thus unsuitable for sensitive foods. Furthermore, the materials are not heat-sealable.

The invention claimed is:

1. A coated paper comprising a base paper and at least three coatings applied thereto, wherein the at least three coatings, proceeding from the base paper, in this sequence, comprise a first hydrophobic barrier layer comprising at least one hydrophobic polymer, a second hydrophilic barrier layer comprising at least one hydrophilic polymer, and a third hydrophobic barrier layer comprising at least one hydrophobic polymer, wherein the at least one hydrophobic polymer contained in the third barrier layer is a thermoplastic polymer, and so the third barrier layer is thus heat-sealable, wherein a pre-coat comprising at least one inorganic pigment and a polymer binder is provided between the base paper and the first barrier layer, and wherein the at least one inorganic pigment comprises a silicate, wherein the coated paper has a sealed-seam strength of from 1.5 N/15 mm to 10 N/15 mm, wherein the sealed-seam strength is determined for the coated paper as follows: the coated paper is sealed at 3.3 bar for 0.3 seconds in a temperature range of from 100° C. to 200° C. transversely to the direction of the paper web and the sealed-seam strength is determined in accordance with DIN 55529 (2012).

2. The coated paper according to claim 1, wherein the first barrier layer comprises substances which are selected from the group of lipophilic substances, waxes, microcrystalline waxes, waxes based on plant oils or fats, waxes based on animal oils or fats, plant waxes, animal waxes, low-molecular polyolefins, polyterpenes, and mixtures thereof.

3. The coated paper according to claim 1, wherein the transfer of hydrophobic substances is reduced or prevented by the second barrier layer.

4. The coated paper according to claim 1, wherein the transfer of hydrophobic substances from the first barrier layer or through the first barrier layer, into the third barrier layer or therebeyond is reduced or prevented.

5. The coated paper according to claim 1, wherein the transfer of hydrophobic substances from the third barrier layer or through the third barrier layer, into the first barrier layer is prevented.

6. The coated paper according to claim 1, wherein the transfer of substances which are selected from the group of lipophilic substances, paraffins, waxes, microcrystalline waxes, waxes based on plant oils or fats, waxes based on animal oils or fats, plant waxes, animal waxes, low-molecular polyolefins, polyterpenes, and mixtures thereof, is reduced or prevented.

7. The coated paper according to claim 1, wherein the third barrier layer, apart from unavoidable or admissible impurities, is free from substances which are selected from the group of lipophilic substances, paraffins, waxes, microcrystalline waxes, waxes based on plant oils or fats, waxes based on animal oils or fats, plant waxes, animal waxes, low-molecular polyolefins, polyterpenes, and mixtures thereof.

8. The coated paper according to claim 1, wherein the base paper has an area density of from 20 to 120 $g/m^2$.

9. The coated paper according to claim 1, wherein the first barrier layer comprises a hydrophobic polymer based on a polyacrylate and/or a polyolefin.

10. The coated paper according to claim 1, wherein the second barrier layer comprises at least one hydrophilic polymer based on a polyvinyl alcohol.

11. The coated paper according to claim 1, wherein the third barrier layer comprises a hydrophobic polymer based on a polyacrylate, a styrene/butadiene copolymer and/or a polyolefin.

12. The coated paper according to claim 8, wherein the inorganic pigment further comprises a polymer binder based on a polyacrylate.

13. The coated paper according to claim 1, wherein no adhesion promoter is used between the individual barrier layers.

14. The coated paper according to claim 1, wherein the coated paper is free from halogen-containing compounds.

15. The coated paper according to claim 1, wherein the coated paper does not comprise an aluminium, $Al_2O_3$ or $SiO_2$ layer.

16. The coated paper according to claim 1, wherein the base paper has a long-fibre content of from 10 to 80% and a short-fibre content of from 20 to 90 wt. %, a long fibre being a fibre with a fibre length of from 2.6 to 4.4 mm and a short fibre being a fibre with a fibre length of from 0.7 to 2.2 mm.

17. A method for producing a coated paper according to claim 1, wherein aqueous suspensions comprising starting materials of the first, second and third barrier layer are applied successively to the base paper, the aqueous application suspensions having a solids content of from 10 to 60 wt. %, and being applied by means of a curtain coating process at an operating speed of the coating plant of at least 200 m/min.

18. The method according to claim 17, wherein the first and second or the second and third barrier layer are applied immediately successively wet-on-wet by means of a double curtain coating process.

* * * * *